US010578107B2

(12) United States Patent
Yorikane et al.

(10) Patent No.: US 10,578,107 B2
(45) Date of Patent: Mar. 3, 2020

(54) LIQUID-COOLED COMPRESSOR AND METHOD FOR OPERATING SAME

(71) Applicant: Hitachi Industrial Equipment Systems Co., Ltd., Chiyoda-ku, Tokyo (JP)

(72) Inventors: Shigeyuki Yorikane, Tokyo (JP); Hiroshi Ohta, Tokyo (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 302 days.

(21) Appl. No.: 15/319,916

(22) PCT Filed: Jun. 25, 2015

(86) PCT No.: PCT/JP2015/068406
§ 371 (c)(1),
(2) Date: Dec. 19, 2016

(87) PCT Pub. No.: WO2016/002635
PCT Pub. Date: Jan. 7, 2016

(65) Prior Publication Data

US 2017/0130720 A1 May 11, 2017

(30) Foreign Application Priority Data

Jul. 2, 2014 (JP) ..... 2014-136877

(51) Int. Cl.
*F04C 28/24* (2006.01)
*F04C 28/06* (2006.01)
(Continued)

(52) U.S. Cl.
CPC ..... *F04C 28/24* (2013.01); *F04B 39/06* (2013.01); *F04B 39/064* (2013.01); *F04B 49/03* (2013.01);
(Continued)

(58) Field of Classification Search
CPC ..... F04C 28/24; F04C 29/021; F04C 29/04; F04C 18/16; F04C 2240/81; F04B 39/06;
(Continued)

(56) References Cited

U.S. PATENT DOCUMENTS 3,961,862 A * 6/1976 Edstrom ..... F04B 39/062 417/282
5,584,673 A * 12/1996 Rein ..... F04B 49/022 417/290
6,519,958 B1 * 2/2003 Moon ..... F24F 11/83 62/199

FOREIGN PATENT DOCUMENTS

JP 47-19143 6/1972
JP 57-41416 Y2 9/1982
(Continued)

OTHER PUBLICATIONS

International Search Report (PCT/ISA/210) issued in PCT Application No. PCT/JP2015/068406 dated Oct. 6, 2015 with English translation (5 pages).
(Continued)

*Primary Examiner* — Philip E Stimpert
(74) *Attorney, Agent, or Firm* — Crowell & Moring LLP

(57) ABSTRACT

Typical liquid-cooled compressors use the effective means of reducing no-load power by repeatedly starting and stopping an electric motor according to the amount of required air, but sufficient consideration has not been given to the fact that frequent starting and stopping of large-output electric motors leads to a decline in motor reliability. In order to solve this problem, a liquid-cooled compressor for circulating a liquid inside a compressor body using a pressure difference, and equipped with a cooling channel for circulating said liquid for cooling, configured so as to have an intake valve for adjusting the air intake of the compressor body, to change the amount of air taken in through the intake
(Continued)

valve, and as a result, to perform a low-pressure operation during no-load operation at two levels of reduced operating pressure consisting of a value no less than a minimum circulation oil supply pressure and a low value. As a result, possible to provide a compressor which balances ensuring the reliability of the compressor and the electric motor during no-load operation of a large-output electric motor, and improving energy efficiency during no-load operation by reducing surplus power.

10 Claims, 5 Drawing Sheets

(51) Int. Cl.

| | |
|---|---|
| ***F04B 49/03*** | (2006.01) |
| ***F04B 39/06*** | (2006.01) |
| ***F04C 29/02*** | (2006.01) |
| ***F04C 29/04*** | (2006.01) |
| ***F04C 18/16*** | (2006.01) |

(52) U.S. Cl.
CPC ..... *F04C 28/06* (2013.01); *F04C 29/021* (2013.01); *F04C 29/04* (2013.01); *F04C 18/16* (2013.01); *F04C 2240/81* (2013.01); *F04C 2270/195* (2013.01)

(58) Field of Classification Search
CPC ..... F04B 39/064; F04B 49/03; F04B 39/062; F04B 49/10
See application file for complete search history.

(56) References Cited

FOREIGN PATENT DOCUMENTS

| | | | |
|---|---|---|---|
| JP | 59-221492 | A | 12/1984 |
| JP | 62-72493 | U | 5/1987 |
| JP | 8-49662 | A | 2/1996 |
| JP | 8-200234 | A | 8/1996 |
| JP | 3262011 | B2 | 3/2002 |
| JP | 2009-243365 | A | 10/2009 |

OTHER PUBLICATIONS

Japanese-language Written Opinion (PCT/ISA/237) issued in PCT Application No. PCT/JP2015/068406 dated Oct. 6, 2015 (5 pages).

* cited by examiner

LIQUID-COOLED COMPRESSOR AND METHOD FOR OPERATING SAME

TECHNICAL FIELD

The present invention relates to a liquid-cooled compressor in which a pressure difference is utilized to inject liquid into a compressor body and a bearing.

BACKGROUND ART

In typical liquid-cooled compressors, liquid is injected in a compression stroke for the purpose of lubrication, sealing, and cooling. Since any droplet must not be contained in compressed air supplied from an air compressor, each liquid-cooled compressor is provided therein with a separator for separating compressed air and liquid from each other. Liquid separated at the separator is trapped at the lower part of the separator. Utilizing a pressure difference between the separator and the compressor body, the liquid is then injected into the compressor body and a bearing by way of a heat exchanger and a filter and lubricates and cools male and female rotors and a bearing.

For this reason, in a capacity control state in which reduced pressure operation is performed under no load, it is necessary to slightly open an intake valve to take in liquid and compress the liquid to a predetermined pressure (hereafter, referred to as reduced pressure operation pressure $P_1$, $P_1>P_2$) in order to maintain a pressure difference (hereafter, referred to as minimum circulation oil supply pressure $P_2$) at which liquid can be recovered into the compressor body and inject the liquid into a bearing and the like to lubricate and cool the same for ensuring reliability. This poses problems that surplus compression power is required and energy efficiency during no-load operation is degraded.

To solve the above problems, a technique in which a compressor is stopped under no load is known. However, when a large-output electric motor is frequently started and stopped, heat in the electric motor is not dissipated and a probability of occurrence of coil burnout or the like is increased. This poses a problem of regraded compressor reliability.

As a background art in the present technical field, there is Japanese Patent No. 3262011 (Patent Literature 1). Patent Literature 1 relating to a screw compressor equipped with a revolving speed controller is based on a technology in which the compressor is automatically started and stopped during capacity control operation to reduce power during no-load operation. Before the compressor is automatically stopped, compression is performed until the pressure is made higher than a specified pressure. Stopping durations are thereby lengthened to prevent increase in a number of stopping times.

CITATION LIST

Patent Literature

PTL 1: Japanese Patent No. 3262011

SUMMARY OF INVENTION

Technical Problem

It is an effective means to repeatedly start and stop an electric motor according to an amount of required air to reduce no-load power as described in. Patent Literature 1.

However, there is a possibility that the capacity of an air reservoir installed on the downstream side of the compressor must be increased to cope with abrupt load variation. In addition, sufficient consideration has not given to the fact that large-output electric motors are frequently started and stopped and this leads to degradation in the reliability of the electric motors.

It is an object of the present invention to provide a compressor that makes it possible to achieve both ensuring the reliability of the compressor and an electric motor during no-load operation of the large-output electric motor and reducing surplus power to enhance energy efficiency.

Solution to Problem

To solve the above-mentioned problems, for example, a configuration element described in CLAIMS is adopted. The present application includes a plurality of means for solving the above-mentioned problems. An example of such means is a liquid-cooled compressor including a cooling channel for circulating cooling liquid and so configured that the liquid is circulated in the compressor body by a pressure difference. The liquid-cooled compressor is provided with an intake valve for adjusting the air intake of the compressor body and is so configured that reduced pressure operation is performed at two levels of a value equal to or higher than a minimum circulation oil supply pressure and a low value during no-load operation by varying an amount of air taken in through the intake valve.

Advantageous Effects of invention

According to one aspect of the present invention, it is possible to provide a compressor which makes is possible to achieve both ensuring the reliability of the compressor and an electric motor during no-load operation of the large-output electric motor and reducing surplus power to enhance energy efficiency during no-load operation.

DESCRIPTION OF EMBODIMENTS

A description will be given to examples of the present invention with reference to the drawings.

Figure 2:
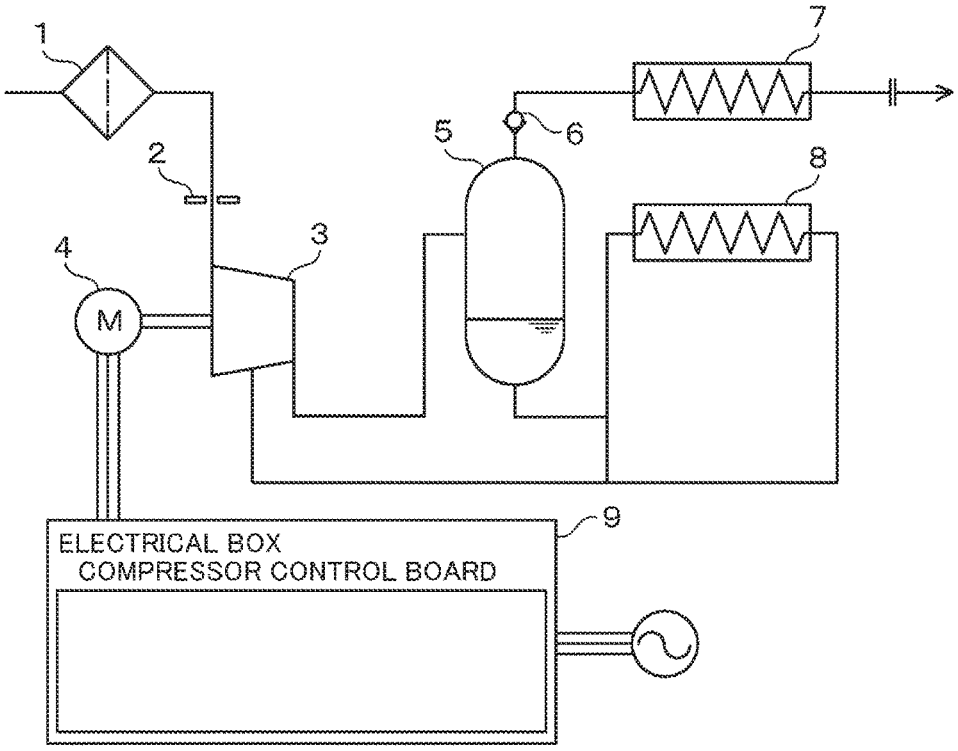
FIG. 2 is a system diagram of a typical liquid-cooled compressor.

First, a description will be given to a typical liquid-cooled compressor. FIG. 2 is a system diagram of the typical liquid-cooled compressor. Referring to FIG. 2, intake air passes through an intake filter 1 and an intake valve 2 from an opening provided in a noise-proof cover (not shown) for reducing noise produced by the compressor. The intake air is then compressed to a predetermined pressure by a compressor body 3 driven by an electric motor 4 revolved by power supplied from an electrical box 9 mounted with a compressor control board. The intake air thereafter passes through an oil separator 5, a pressure regulating check valve 6, an after cooler 7, and a dryer (not shown) and is then connected to a source external to the compressor and used for various applications. Meanwhile, circulating oil is compressed together with air in the compressor body 3 and separated from compressed air at an oil separator 5. The oil is thereafter cooled at an oil cooler 8 and passes through an oil filter (not shown) and the like and then circulated in a channel for supply to male and female rotors, a bearing, and the like housed in the compressor body.

During no-load operation, the pressure on the downstream side (secondary side) of the pressure regulating check valve is maintained through a valving function of the pressure regulating check valve 6; therefore, compression power is reduced by releasing the pressure maintained in the oil separator 5 to the atmosphere.

Figure 3:
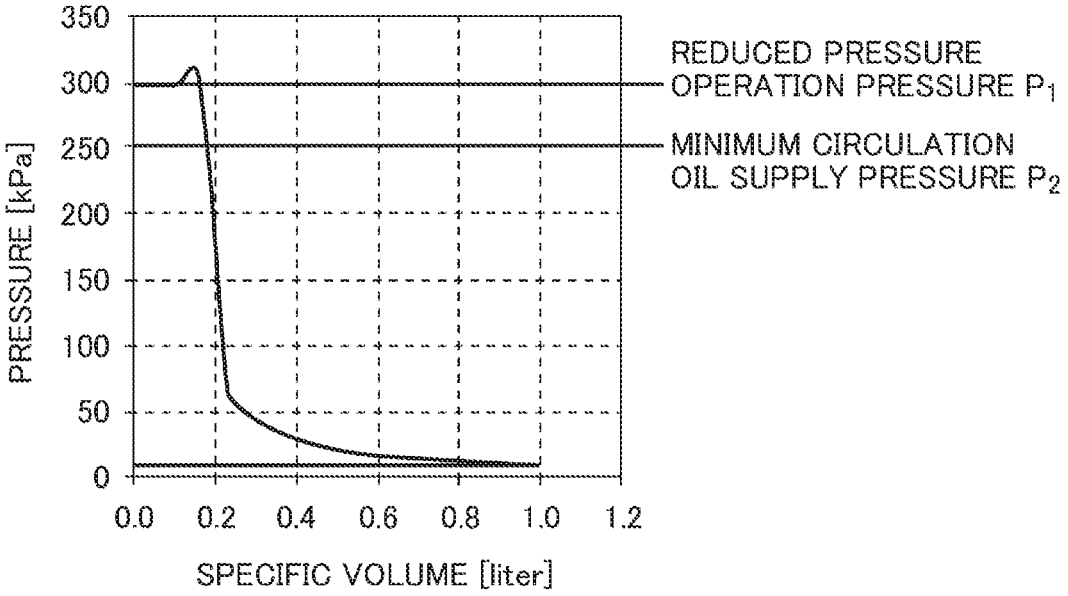
FIG. 3 is a PV diagram of a typical liquid-cooled compressor in no-load operation.

FIG. 3 is a PV (Pressure Volume) diagram of a typical liquid-cooled compressor in no-load operation. During no-load operation, as indicated in FIG. 3, an intake valve 2 is slightly opened to lubricate and cool male and female rotors and a bearing housed in the compressor body. Thus, compression is performed to a reduced pressure operation pressure $P_1$ at which operation is performed at a pressure lower than a specified operating pressure such that a minimum circulation oil supply pressure $P_2$ with a pressure loss in an oil cooler 8 or a channel taken into account is exceeded. For this reason, redundant compression power is generated during no-load operation.

Example 1

Figure 1:
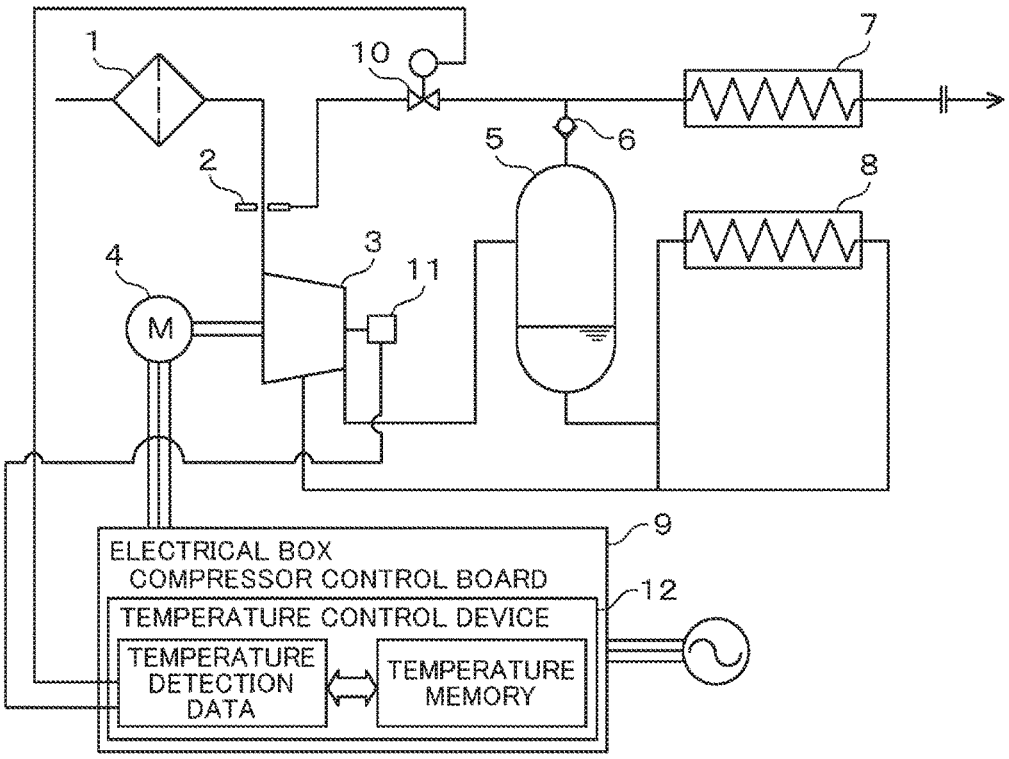
FIG. 1 is a system diagram of a liquid-cooled compressor in Example 1.

FIG. 1 is a system diagram of a liquid-cooled compressor in this example. A description of items common to those in FIG. 2 will be omitted. Referring to FIG. 1, the liquid-cooled compressor in this example is provided with a switchgear 10 in a channel connecting the downstream side (secondary side) of the pressure regulating check valve 6, that is, a point where a pressure is maintained during no-load operation and the intake valve 2. The compressor body 3 is provided with a temperature detector 11 for detecting bearing temperature and a temperature control device 12 housed in the electrical box 9 for controlling opening and closing of the switchgear 10 according to an output from the temperature detector 11.

Figure 4:
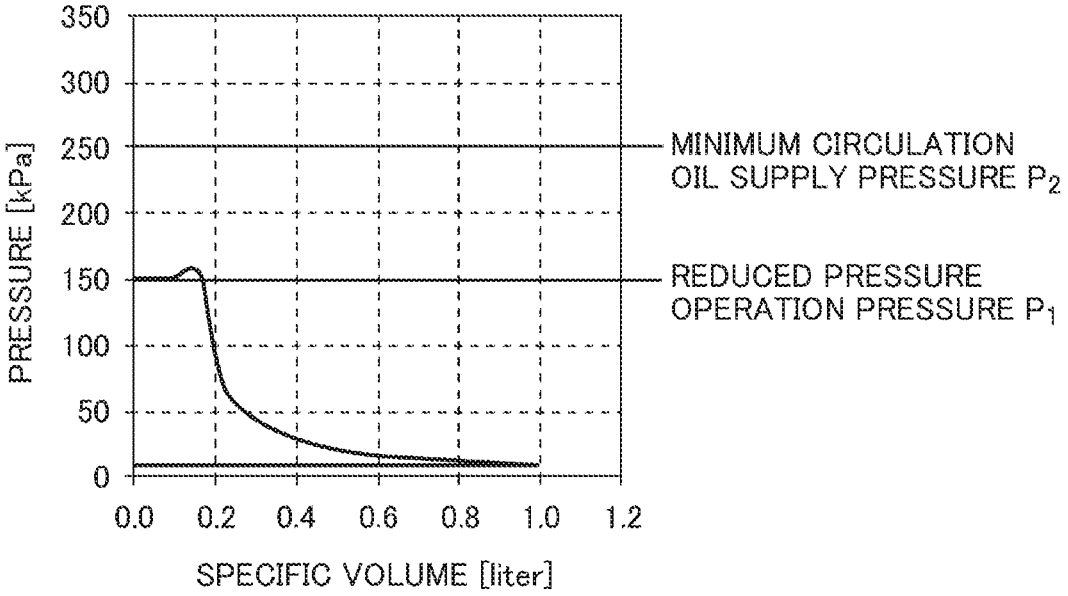
FIG. 4 is a PV diagram of a liquid-cooled compressor in Example 1 in no-load operation.

Hereafter, a description will be given to operation of the liquid-cooled compressor in this example. FIG. 4 is a PV diagram of the liquid-cooled compressor in this example in no-load operation. As indicated in FIG. 4, no-load operation is performed at a reduced pressure operation pressure $P_1$ (for example, 0.15 MPa) lower than a minimum circulation oil supply pressure $P_2$ (for example, 0.25 MPa). When $P_1<P_2$, lubricating oil is not circulated. For this reason, when no-load operation is continued for a long time, the bearing temperature in the compressor body starts to rise. The bearing temperature is monitored with the temperature detector 11 attached to the compressor and detected temperature data and predetermined temperature memory (for example, upper-limit temperature $TP_1$=100° C., lower-limit temperature $TP_2$=60° C.) are compared with each other at the temperature control device 12 incorporated into the compressor control board. When temperature detection data exceeds 100° C., an open command is issued from the compressor control board to the switchgear 10 to supply the pressure on the downstream side of the pressure regulating check valve 6 to the intake valve 2.

The intake valve 2 is a valve opened in conjunction with pressure rise. Consequently, the intake valve 2 is slightly opened and the compressor body 3 takes in a very small quantity of air, the reduced pressure operation pressure $P_1$ thereby becoming equal to or higher than the minimum circulation oil supply pressure $P_2$ ($P_1 \geq P_2$). As a result, lubricating oil starts to circulate and lubricates and cools the bearing and the male and female rotors. When the temperature detection data becomes lower than 60° C., a close command is issued from the compressor control board to the switchgear 10 to cause the intake valve 2 to transition from a slightly open state to a closed state. As indicated in FIG. 3, operation is performed again at the reduced pressure operation pressure $P_1$=0.15 MPa.

Figure 5:
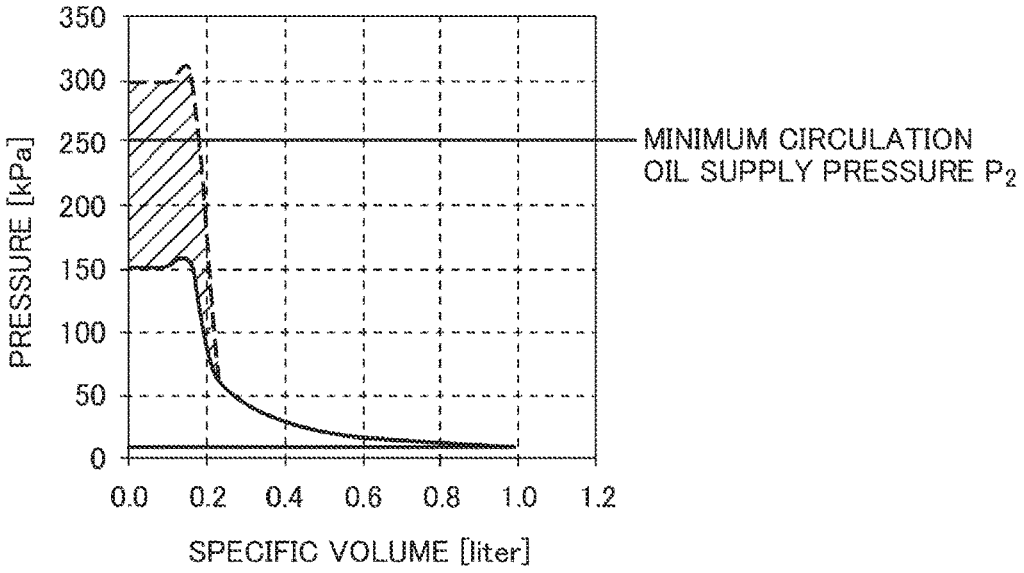
FIG. 5 is a drawing indicating compression power reducing effect by a liquid-cooled compressor in Example 1 under no load.

FIG. 5 illustrates a compression power reducing effect of this example under no load. The diagonally shaded area in FIG. 5 is equivalent to a reduced work done and the compression power thereby reduced is approximately 30%.

As described up to this point, this example is a liquid-cooled compressor including a cooling channel for circulating cooling liquid and so configured that the liquid is circulated in the compressor body by a pressure difference.

The liquid-cooled compressor is provided with an intake valve for adjusting the air intake of the compressor body and so configured that reduced pressure operation is performed at two levels of reduced pressure operation pressure, a value equal to or higher than a minimum circulation oil supply pressure and a low value during no-load operation by varying the amount of air taken in through the intake valve.

In other words, this example is a method for operating a liquid-cooled compressor including a cooling channel for circulating cooling liquid and so configured that the liquid is circulated in the compressor body by a pressure difference. In the method, during no-load operation, a first reduced pressure operation at a reduced pressure operation pressure lower than a minimum circulation oil supply pressure and a second reduced pressure operation at a reduced pressure operation pressure equal to or higher than the minimum circulation oil supply pressure are performed.

According to this example, in ordinary no-load operation, the operation is performed at a reduced pressure operation pressure $P_1$ lower than a minimum circulation oil supply pressure $P_2$ and the pressure is temporarily increased to the minimum circulation oil supply pressure $P_2$ for protection of a bearing and the like. By forcedly circulating liquid, it is possible to provide a compressor in which it is possible to achieve both ensuring the reliability of the compressor and an electric motor in no-load operation of the large-output electric motor and reducing surplus power to enhance energy efficiency during no-load operation.

Specifically, in no-load operation, reduced pressure operation is performed at two levels of a reduced pressure operation pressure $P_1$, a value equal to or higher than a minimum circulation oil supply pressure $P_2$ and a low value. This makes it possible to provide a compressor in which it is possible to achieve both ensuring the reliability of the compressor and the electric motor and reducing surplus power to enhance energy efficiency without stopping the electric motor.

In the above-mentioned example, fluid to be compressed is air but any other gas may be adopted instead. In the above-mentioned example, liquid injected into the compressor body is oil but any other liquid, such as water, may be adopted instead. In the above-mentioned example, an electric motor is used but a prime mover may be used instead.

The compressor body in the above-mentioned example is applicable to a screw compressor, a scroll compressor, a reciprocating compressor, or the like regardless of the compression scheme thereof.

In the above-mentioned example, the temperature detected with the temperature detector 11 is bearing temperature but compressor case temperature or male and female rotors temperature may be detected instead. Instead of the temperature detector, a device for detecting vibration or sound may be adopted.

In the above-mentioned example, determination is carried out at the temperature control device 12 based on detected temperature. Instead, determination may be carried out based on a temperature difference from the temperature of the atmosphere taken into the compressor, that is, a temperature rise value. In this case, a temperature detector for measuring atmospheric temperature required but determination can be carried out regardless of surrounding environments, such as season and installation area, by using a temperature rise value for determination.

Example 2

Figure 6:
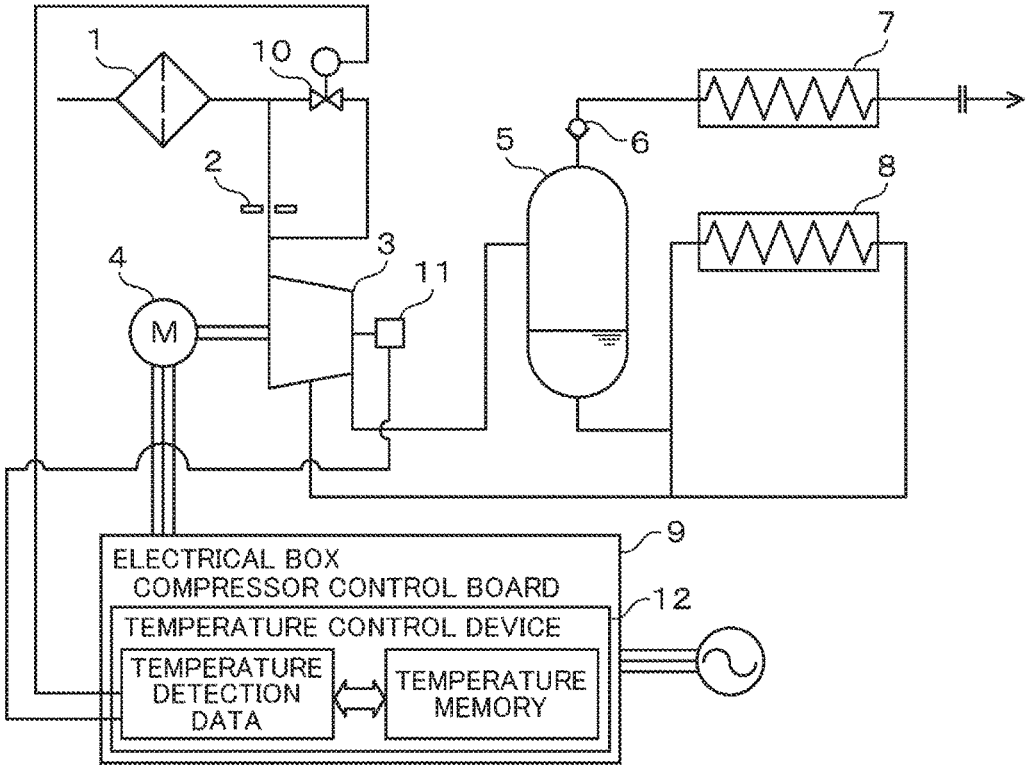
FIG. 6 is a system diagram of a liquid-cooled compressor in Example 2.

FIG. 6 is a system diagram of a liquid-cooled compressor in this example. A description of items common to those in Example 1 will be omitted. This example is different from Example 1 in that the switchgear 10 is provided in a channel connecting the upstream side and downstream side (primary side and secondary side) of the intake valve 2.

A description will be given to operation of the liquid-cooled compressor in this example. Referring to FIG. 6, in no-load operation, the operation is performed at a reduced pressure operation pressure $P_1$ lower than a minimum circulation oil supply pressure $P_2$ ($P_1<P_2$). When no-load operation is continued for a long time and bearing temperature rise is detected at the temperature detector 11, an open command is issued from the temperature control device 12 to the switchgear 10 to let the upstream side and downstream side of the intake valve 2 communicate with each other. Thus, air is taken into the compressor body 3 from the secondary side of the intake filter 1 equivalent to the upstream side of the intake valve 2; as a result, operation is performed at a reduced pressure operation pressure $P_1$ equal to or higher than the minimum circulation oil supply pressure $P_2$ ($P_1 \geq P_2$). When the temperature detector 11 thereafter detects that a bearing has been cooled, a close command is issued from the temperature control device 12 to the switchgear 10. As a result, operation is performed again at a reduced pressure operation pressure $P_1$ lower than the minimum circulation oil supply pressure $P_2$ ($P_1<P_2$).

As mentioned above, according to this example, the upstream side and downstream side of the intake valve 2 are just bypassed and this brings about an effect of the construction being simplified as compared with Example 1. As in Example 1, during no-load operation, reduced pressure operation is performed at two levels of reduced pressure operation pressure $P_1$, a value equal to or higher than the minimum circulation oil supply pressure and a low value. This makes it possible to provide a compressor in which it is possible to achieve both ensuring the reliability of the compressor and an electric motor during no-load operation of the large-output electric motor and reducing surplus power to enhance energy efficiency without stopping the electric motor.

In this example, the switchgear 10 is installed in a channel letting the upstream side and downstream side of the intake valve 2 communicate with each other. Instead, the switchgear may be installed in a channel letting the downstream side (secondary side) of the pressure regulating check valve 6 and the downstream side (secondary side) of the intake valve 2 communicate with each other. In this case, a pressure difference is increased and this brings about an effect that the switchgear 10 and the connecting channel can be reduced in size.

Example 3

Figure 7:
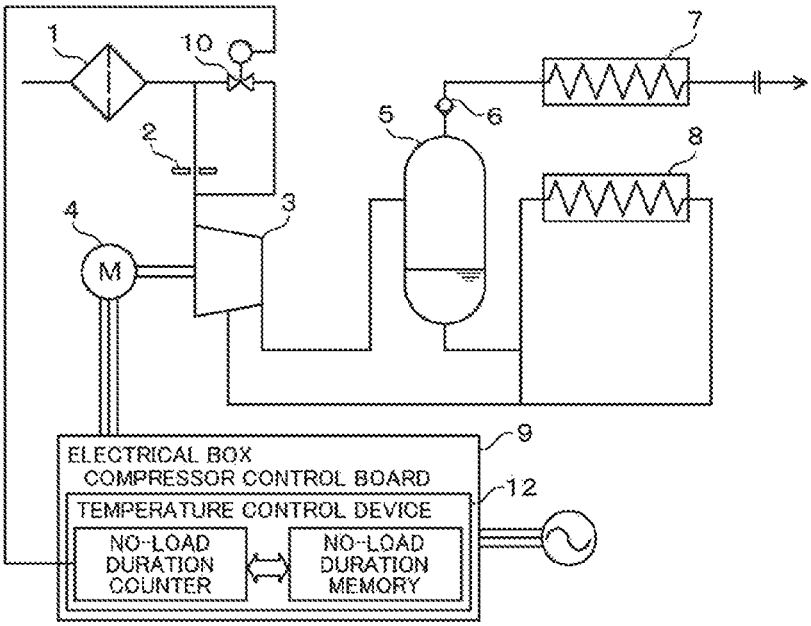
FIG. 7 is a system diagram of a liquid-cooled compressor in Example 3.

FIG. 7 is a system diagram of a liquid-cooled compressor in this example. A description of items common to those in Examples 1 and 2 will be omitted. This example is different from Example 2 in that: the temperature detector 11 is not used; and the temperature control device 12 housed in the electrical box 9 for controlling opening and closing the switchgear 10 exercises control based on a duration of no-load operation.

Hereafter, a description will be given to operation of a liquid-cooled compressor in this example. Referring to FIG. 7, in no-load operation, the operation is first performed at a reduced pressure operation pressure $P_1$ lower than a minimum circulation oil supply pressure $P_2$ ($P_1<P_2$). The temperature control device 12 incorporated into the compressor control board has a function of a duration totalizer calculating a duration of no-load operation and compares a duration of no-load operation with a predetermined no-load duration memory. When a predetermined no-load duration (for example, $T_1$=10 min) is exceeded, an open command is issued from the compressor control board to the switchgear 10 to let the upstream side and downstream side of the intake valve 2 communicate with each other. Operation is thereby performed at a reduced pressure operation pressure $P_1$ equal to or higher than the minimum circulation oil supply pressure $P_2$ ($P_1 \geq P_2$). When a specified no-load duration (for example, $T_2$=5 min) has lapsed, a close command is issued from the temperature control device 12 to the switchgear 10. Operation is thereby performed again at a reduced pressure operation pressure $P_1$ lower than the minimum circulation oil supply pressure $P_2$ ($P_1<P_2$).

As mentioned above, this example brings about an effect that unlike Examples 1 and 2, necessity for a temperature detector is obviated and the compressor can be inexpensively constructed. As in Examples 1 and 2, during no-load operation, reduced pressure operation is performed at two levels of reduced pressure operation pressure a value equal to or higher than the minimum circulation oil supply pressure $P_2$ and a low value. This makes it possible to provide a compressor in which it is possible to achieve both ensuring the reliability of the compressor and an electric motor during no-load operation of the large-output electric motor and reducing surplus power to enhance energy efficiency without stopping the electric motor.

In this example, the temperature control device 12 makes a determination based on a duration of no-load operation but a determination may be made based on a number of times of no-load operation. In this case, control is exercised, for example, such that operation is performed at a reduced pressure operation pressure $P_1$ equal to or higher than the minimum circulation oil supply pressure $P_2$ ($P_1 \geq P_2$) only once of 10 times of no-load operation.

Example 4

In the description of the above examples, a reduced pressure operation pressure $P_1$, temperature memory, and the like are preset. In this example described below, these values are set from an operation panel for operating the compressor.

Figure 8:
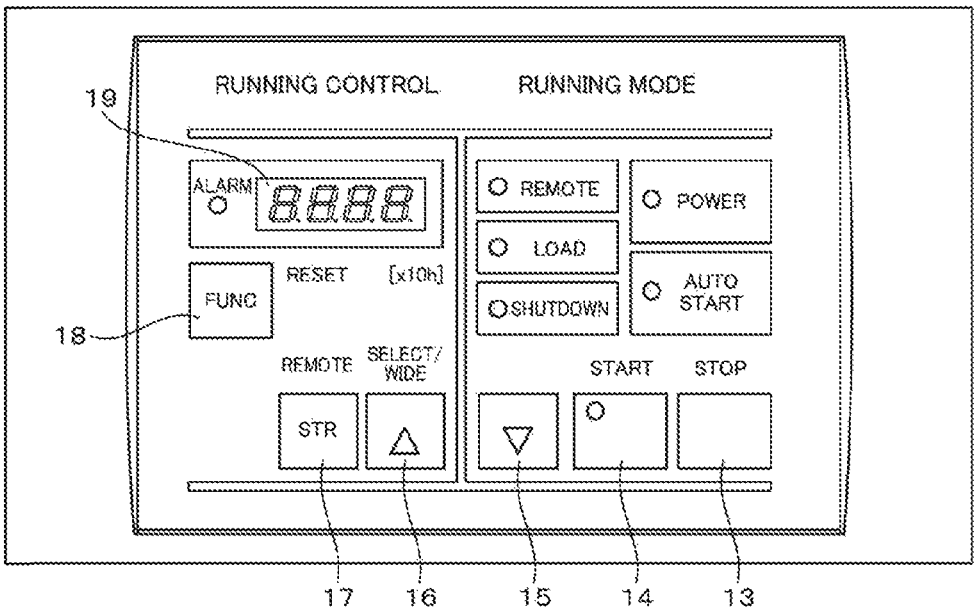
FIG. 8 is a drawing illustrating an operation panel of a liquid cooled compressor in Example 4.

FIG. 8 illustrates an operation panel of a liquid-cooled compressor in this example. Referring to FIG. 8, reference numeral 19 denotes a display block and other reference numerals denote function buttons. Specifically, reference numeral 14 denotes a START button for starting operation of the compressor; 13 denotes a STOP button stopping operation of the compressor; and 15 and 16 denote buttons for incrementing and decrementing a displayed value; 17 denotes a SIR button for storing set data; and 18 denotes a FUNC button for changing an input mode. The other areas are display portions for displaying a running mode.

Figure 9:
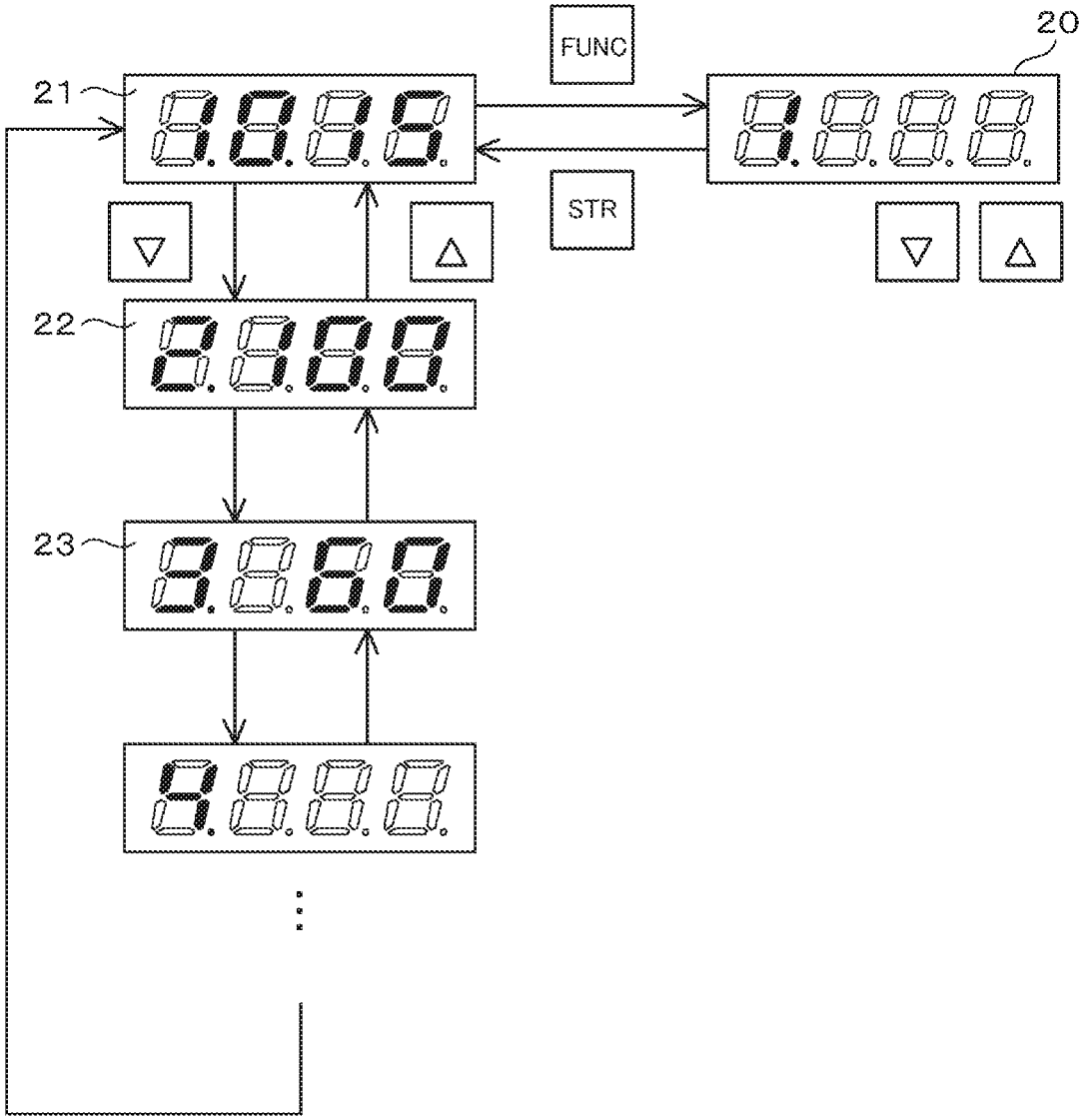
FIG. 9 is a drawing explaining a setting procedure for set values for a liquid-cooled compressor in Example 4.

FIG. 9 illustrates a state of the display block 19 in the operation panel in FIG. 8, showing a procedure taken to set various set values.

Referring to FIG. 9, the FUNC button 18 is first pressed to establish an item selecting mode in which an item can be selected. Specifically, the leftmost portion of the display block indicates an item number and the right portion indicates a numerical value. The FUNC button 18 is pressed and the incrementing or decrementing button 15, 16 is used to select an item. In the example in FIG. 9, reference numeral 20 denotes a case where Item 1 is selected. The item contents corresponding to each item number is stored beforehand. A description of this example will be given on the assumption that 1: reduced pressure operation pressure $P_1$ lower than a minimum circulation oil supply pressure $P_2$, 2: upper-limit temperature $TP_1$, and 3: lower-limit temperature $TP_2$.

After a desired item number is selected, the FUNC button 18 is pressed to establish a numerical value input mode. Thereafter, the incrementing or decrementing button 15, 16 is used to display a desired numerical value. The STR button 17 is then pressed to store the data.

Thereafter, the FUNC button 18 and the incrementing or decrementing button 15, 16 are similarly operated to make setting for any other item desired to change. In the example in FIG. 9, reference numeral 21 indicates a case where 1: reduced pressure operation pressure=0.15 Mpa is set; 22 indicates a case where 2: upper-limit temperature=100° C. is set; and 23 indicates a case where 3: lower-limit temperature=60° C. is set.

The description of this example is based on the assumption that the FUNC button and the incrementing or decrementing button are used to provide a setting screen in which at least a reduced pressure operation pressure lower than a minimum circulation oil supply pressure, an upper-limit temperature, and a lower-limit temperature can be set. Needless to add, the present invention is not limited to this. For example, the present invention may be configured such that two reduced pressure operation pressures as two levels of reduced pressure operation pressure can be individually set or durations of no-load operation $T_1$ and $T_2$ used in Example 3 can be set. Alternatively, a pull-down scheme may be adopted such that a numerical value is selected from predetermined items for setting.

As mentioned above, according to this example, at least a reduced pressure operation pressure lower than a minimum circulation oil supply pressure, an upper-limit temperature, and a lower-limit temperature can be arbitrarily set. For example, when a reduced pressure operation pressure $P_1$ described in relation to Example 1 is brought closer to 0, it is possible to reduce surplus power to enhance energy efficiency; and when an upper-limit temperature $TP_1$ is set to a value higher than 100° C., a duration of no-load operation is lengthened and energy efficiency can be enhanced.

Up to this point, the description has been given to the examples the present invention is not limited to the above-mentioned examples and includes various modifications. The above examples have been described in detail for making the present invention easily understandable and need not include all the configuration elements described above. A part of the configuration elements of an example may be replaced with a configuration element of another example; and a configuration element of as example may be added to the configuration elements of another example. A different configuration element may be added to or replaced with a part of the configuration elements of each example and a part of the configuration elements of each example may be deleted.

REFERENCE SIGNS LIST

1 . . . Intake filter,
2 . . . Intake valve,
3 . . . Compressor body,
4 . . . Electric motor,
5 . . . Oil separator,
6 . . . Pressure regulating check valve,
7 . . . After cooler,
8 . . . Oil cooler,
9 . . . Electrical box,
10 . . . Switchgear,
11 . . . Temperature detector,
12 . . . Temperature control device.

The invention claimed is:

1. A liquid-cooled compressor provided with a cooling channel for circulating cooling liquid and so configured that the liquid is circulated in a compressor body by a pressure difference, comprising:

intake valves configured to adjust the air intake of the compressor body, wherein during no-load operation, reduced pressure operation is performed at two levels of reduced pressure operation pressure by varying the amount of air taken in through the intake valve, the two levels being a first value equal to or higher than a minimum circulation oil supply pressure and a second value lower than the minimum circulation oil pressure;

a channel letting a place, located on a downstream side of the compressor body where a pressure is maintained, and the intake valves communicate with each other during no-load operation; and a switchgear provided in the channel, wherein reduced pressure operation is performed at the two levels of reduced pressure operation pressure by action of the switchgear.

2. The liquid-cooled compressor according to claim 1, comprising:

a temperature detector, wherein the switchgear is actuated according to a value detected at the temperature detector.

3. The liquid-cooled compressor according to claim 2, wherein when the value detected at the temperature detector exceeds a first value, the switchgear is opened to open the intake valve and reduced pressure operation is performed at, and wherein when the value detected at the temperature detector becomes lower than a second value lower than the first value, the switchgear is closed to close the intake valve and reduced pressure operation is performed at the second value.

4. The liquid-cooled compressor according to claim 1, wherein there is provided a setting screen in which the second value, an upper-limit temperature and a lower-limit temperature of the compressor body can be set, and wherein during the no-load operation, when the temperature of the compressor body exceeds the upper-limit temperature, operation is performed at and when the temperature of the compressor body becomes lower than the lower-limit temperature, operation is performed at the second value.

5. A liquid-cooled compressor provided with a cooling channel for circulating cooling liquid and so configured that the liquid is circulated in a compressor body by a pressure difference, comprising:

an intake valve for adjusting the air intake of the compressor body, wherein during no-load operation, reduced pressure operation is performed at two levels of reduced pressure operation pressure, a value equal to or higher than a minimum circulation oil supply pressure and a low value, wherein the reduced pressure operation is performed by varying the amount of air taken in through the intake valve;

a channel letting the upstream side and downstream side of the intake valve communicate with each other; and a switchgear provided in the channel, wherein reduced pressure operation is performed at the two levels of reduced pressure operation pressure by action of the switchgear.

6. The liquid-cooled compressor according to claim 5, comprising:

a duration totalizer for calculating a duration of the no-load operation, wherein the switchgear is actuated according to a totalized duration of the no-load operation.

7. The liquid-cooled compressor according to claim 6, wherein during no-load operation, when the totalized duration exceeds a first value, the switchgear is opened to slightly open the intake valve and reduced pressure operation is performed at the first value, and wherein when the totalized duration thereafter exceeds a second value, the switchgear is closed to close the intake valve and reduced pressure operation is performed at the second value.

8. A method for operating a liquid-cooled compressor, comprising:

providing intake valves;

providing a cooling channel for circulating cooling liquid configured such that the liquid is circulated in a compressor body by a pressure difference, wherein during no-load operation, a first reduced pressure operation at a reduced pressure operation pressure lower than a minimum circulation oil supply pressure and a second reduced pressure operation at a reduced pressure operation pressure equal to or higher than the minimum circulation oil supply pressure are performed; and providing a channel letting a place, located on a downstream side of the compressor body where a pressure is maintained, and the intake valves communicate with each other during no-load operation; and providing a switchgear in the channel, wherein reduced pressure operation is performed at the two levels of reduced pressure operation pressure by action of the switchgear.

9. The method according to claim 8, wherein switching is carried out between the first reduced pressure operation and the second reduced pressure operation according to the temperature of the compressor body.

10. The method according to claim 8, wherein switching is carried out between the first reduced pressure operation and the second reduced pressure operation according to a duration of the no-load operation.

* * * * *